US006776277B2

(12) United States Patent
Wiehler

(10) Patent No.: US 6,776,277 B2
(45) Date of Patent: Aug. 17, 2004

(54) CONVEYOR DEVICE FOR TRANSPORTING AND EXPELLING MATERIAL TO BE CONVEYED

(75) Inventor: Rolf Wiehler, Allensbach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/220,664

(22) PCT Filed: Mar. 6, 2001

(86) PCT No.: PCT/DE01/00851

§ 371 (c)(1),
(2), (4) Date: Sep. 4, 2002

(87) PCT Pub. No.: WO01/66446

PCT Pub. Date: Sep. 13, 2001

(65) Prior Publication Data

US 2003/0019719 A1 Jan. 30, 2003

(30) Foreign Application Priority Data

Mar. 9, 2000 (DE) ..... 100 11 510

(51) Int. Cl.[7] ..... B65G 47/10
(52) U.S. Cl. ..... 198/369.2; 271/225
(58) Field of Search ..... 198/369.2; 271/225; 226/110, 109; 209/941, 918

(56) References Cited

U.S. PATENT DOCUMENTS

| | | | | |
|---|---|---|---|---|
| 2,145,606 A | * | 1/1939 | Megela | 72/251 |
| 4,003,462 A | * | 1/1977 | Perrott | 198/369.2 |
| 4,011,935 A | | 3/1977 | Massey | 198/365 |
| 4,733,768 A | * | 3/1988 | Aquino et al. | 198/369.2 |
| 5,078,255 A | * | 1/1992 | Haley | 198/358 |
| 5,715,930 A | | 2/1998 | Hogenkamp | 198/435 |
| 6,523,668 B2 | * | 2/2003 | Wolz | 198/369.2 |

FOREIGN PATENT DOCUMENTS

| | | | |
|---|---|---|---|
| DE | 2 108 023 | 8/1972 | |
| DE | 27 54 616 | 6/1979 | B65G/47/52 |
| DE | 43 23 566 A1 * | 1/1995 | |
| DE | 44 38 207 A1 | 5/1996 | B65G/47/64 |
| US | 2002/0070149 | 6/2002 | B07C/5/02 |

* cited by examiner

*Primary Examiner*—Richard Ridley
(74) *Attorney, Agent, or Firm*—Philip G. Meyers

(57) ABSTRACT

The invention relates to a conveyor device for transporting and expelling material to be conveyed, especially flat postal items. The inventive device comprises vertically pivotable conveying modules that are arranged one behind the other. The aim of the invention is to reduce the closing time required by the pivoted conveyor module component to go back to the level of the succeeding conveyor module component. The component of the conveyor modules is designed in such a way that said component can also be driven in the vertical direction, whereby said component is the front component when seen in the conveying direction. Immediately after a material to be conveyed (3) has been expelled and when the next material to be conveyed (3) is transported further, said front component of the conveyor module (1) that succeeds the expelling conveyor module (1) is pivoted against the component that is pivoted for expelling. Said front component is pivoted back upwards when the transport level of said component is situated underneath or at least at the same height in relation to the transport level of the previous, expelling conveyor module (1).

8 Claims, 2 Drawing Sheets

CONVEYOR DEVICE FOR TRANSPORTING AND EXPELLING MATERIAL TO BE CONVEYED

Figure 1:
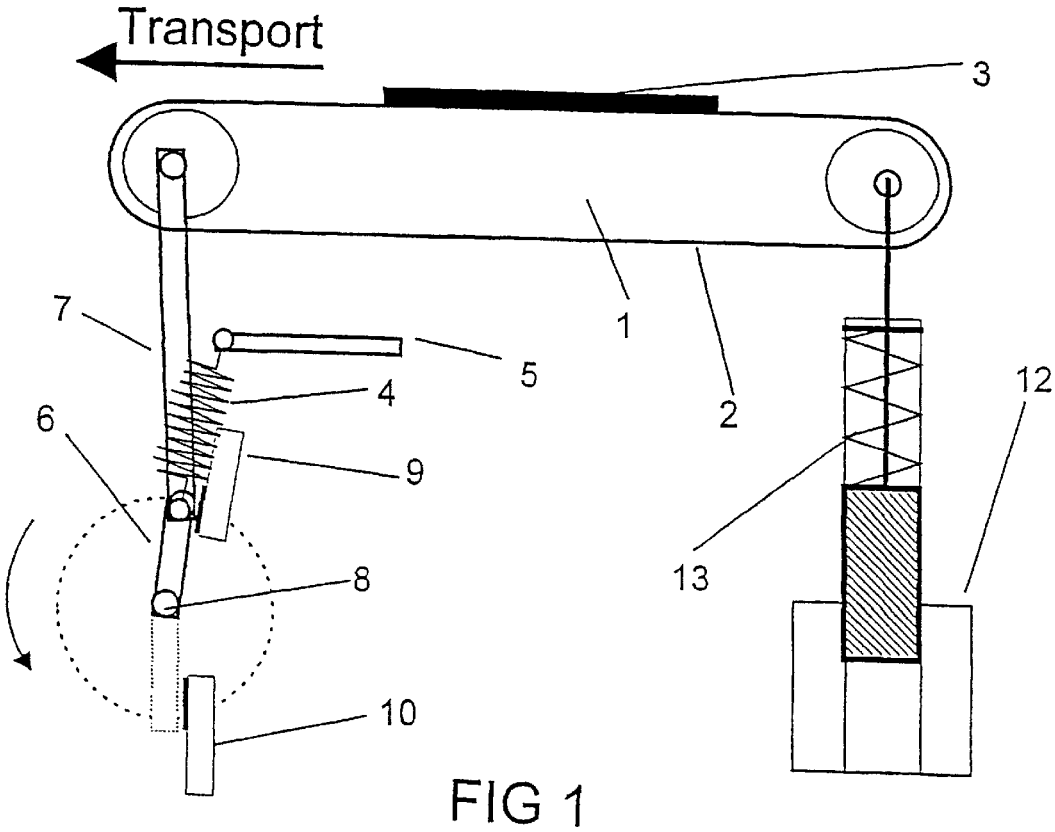

The invention relates to a conveyor device for transporting and expelling material to be conveyed, in particular flat items of mail, having vertically pivotable conveyor modules arranged one behind another.

By means of specific expulsion at the respective conveyor module, the material to be conveyed can be sorted into further conveyor devices or into containers associated with the conveyor modules (DE-A 2 108 023).

In order to permit short gaps between the material to be conveyed and sorted, and therefore a high throughput, it is necessary to carry out the pivoting movements even while there is still material to be conveyed on the conveyor module. For example, on a conveyor module that has already been pivoted downward into the expulsion position, there may be material to be conveyed which is actually to be transported onward horizontally. When this conveyor module is pivoted up and stops in the end position, the material to be conveyed and located loosely on the conveyor module can jump up and lose contact with the conveyor means. As a result, undefined positions of the material to be conveyed, including displacements of the gaps, may arise. Furthermore, increased wear and the high production of noise is associated with the sudden braking from the full pivoting speed.

In order to avoid the disadvantages, to configure the speed of the pivoting movement in such a way that the accelerations at the start and end of the pivoting movements are as small as possible, DE 44 38 207 A1 has already suggested the use of a crank drive with a sinusoidal movement curve to drive vertically pivotable transfer devices. In this case, after the pivoting movements for conveyance or expulsion, the conveyor module has to remain in the end positions for a certain time, in particular in the upper end position, in a stable manner. The material to be conveyed located on the respective conveyor module as the latter is pivoted up must reach the end of the conveyor module only when the latter has reached its horizontal end position, since otherwise the material to be conveyed would collide with the following conveyor module.

A further increase in the throughput by increasing the pivoting speed is not possible because of the associated danger, already outlined, of the material to be conveyed lifting off the transport plane and the gap displacements associated with this.

The invention described in claim 1 is therefore based on the object of configuring the closing operation following the expulsion in such a way that shorter distances between the materials to be conveyed are permissible without increasing the pivoting speeds.

In this case, the invention is based on the idea of shortening the closing time, during which the conveyor module part pivoted out reaches the level of the following conveyor module part again in that, in the conveying direction, the front part of the conveyor module is likewise designed such that it can be displaced in a vertical direction and, immediately after material to be conveyed has been expelled, if the next material to be conveyed is to be transported onward, this front part of the conveyor module following the conveyor module to be expelled is pivoted toward the part pivoted out for the purpose of expulsion and, when it is located with its transport level underneath the transport level of the preceding, a expelling conveyor module or at least at the same height, it is pivoted back up again.

This permits the distances between the materials to be conveyed to be reduced in such a way that the next material to be conveyed and not to be expelled after the expulsion operation may reach this conveyor module before the closing movement has been completed.

Advantageous refinements of the invention are specified in the subclaims.

Thus, in order to achieve the shortest possible distances between the materials to be conveyed, it is beneficial for the front part, in the conveying direction, of the conveyor module following the expelling conveyor module, during the closing movement of the expelling conveyor module to be pivoted downward only until both conveyor modules are located with the conveyor level of their mutually adjacent parts at approximately the same height, and is then immediately pivoted upward again.

In order to reduce the outlay, it is advantageous to guide the front part, in the conveying direction, of the conveyor module vertically rectilinearly displaceably, and to guide the rear part in such a way that the necessary horizontal movement components can be executed. In an advantageous drive variant, the front part of the conveyor module is connected to a controllable lifting element. A lifting magnet or a pneumatic lifting cylinder, for example, can be employed as the lifting element.

A spring element can also act on the front part, in the conveying direction, of the conveyor module as an energy store.

In addition, to achieve a sinusoidal vertical movement curve, it is advantageous to connect the rear part, in the conveying direction, of the conveyor module to the push rod of a crank drive.

Figure 2:
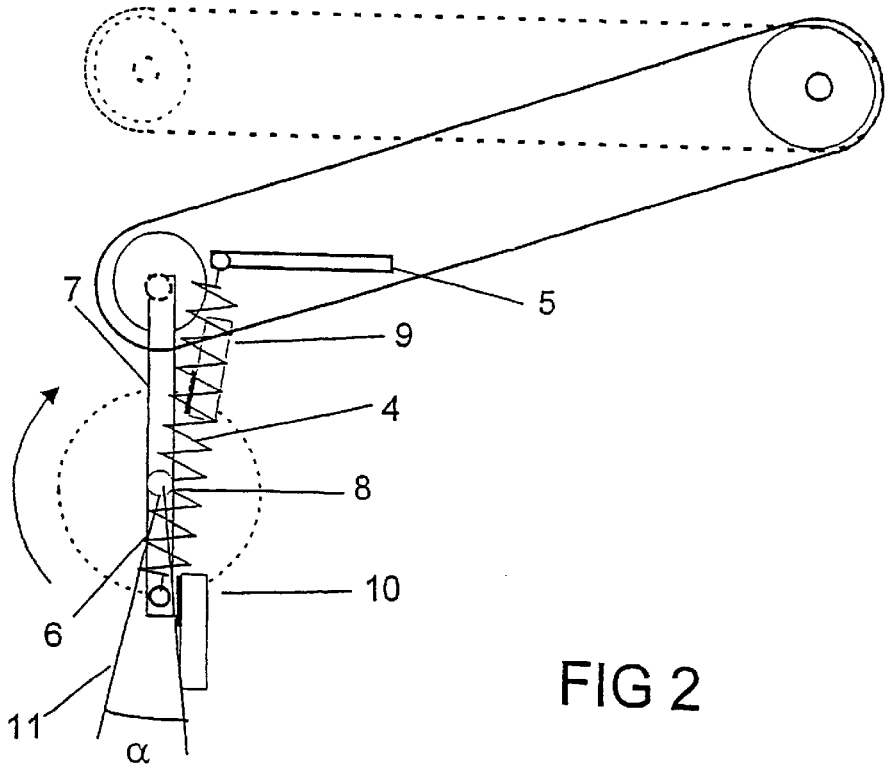
Figure 3A:
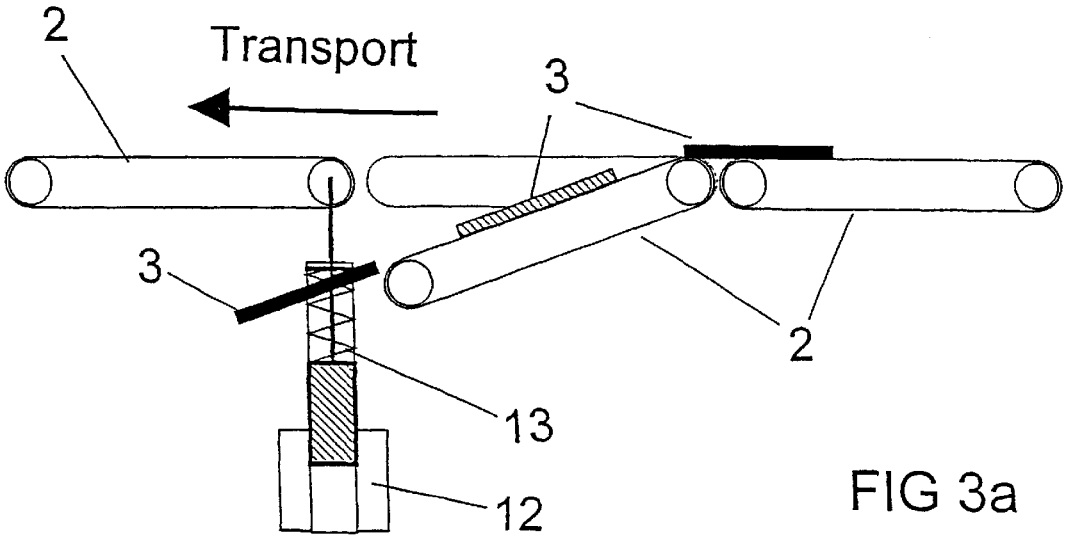
Figure 3B:
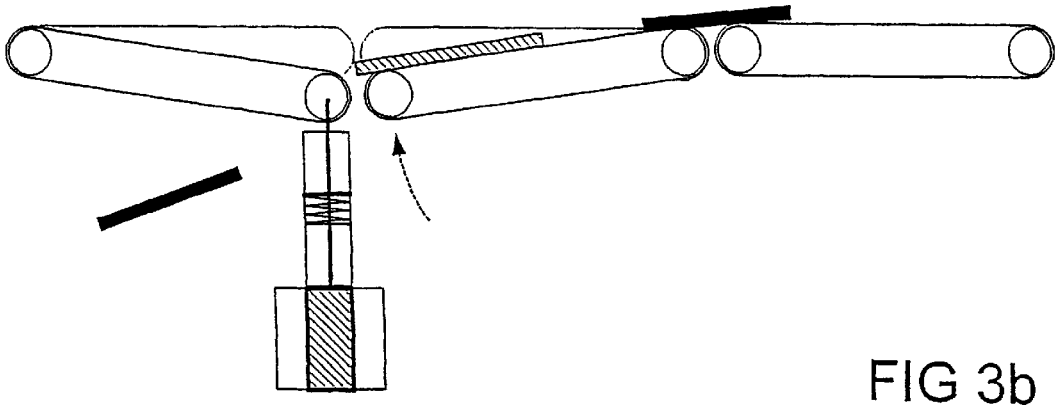
Figure 3C:
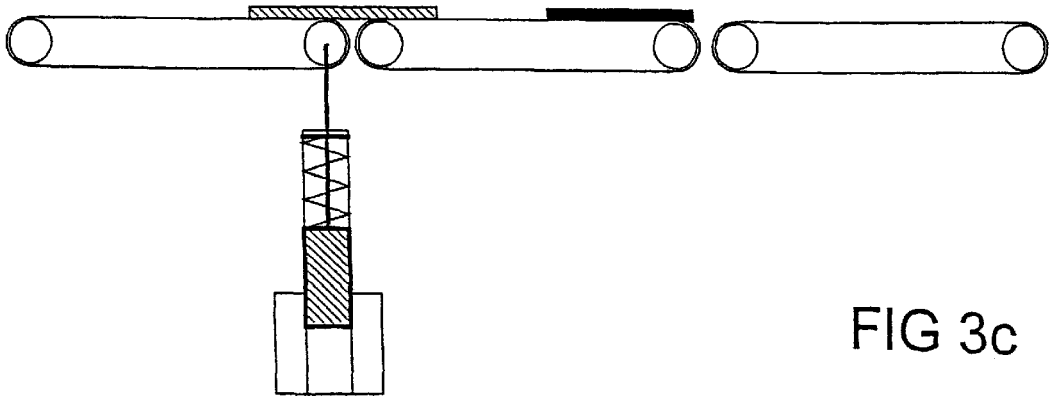

The invention will be explained in more detail below in an exemplary embodiment and using the drawing, in which:

FIG. 1 shows a schematic side view of a conveyor module having an endless transport belt in the horizontal transport position, FIG. 2 shows a schematic side view of a conveyor module in the expulsion position, FIGS. 3*a–c* show schematic side views of three conveyor modules having two flat materials to be conveyed in different transport phases.

As can be gathered from FIG. 1, a conveyor module 1 has a driven, circulating conveyor belt 2 which is guided over two rollers. The lengthened axle of the roller of the inlet side is at the same time the pivoting axis of the module for the purpose of pivoting from the conveying into the expulsion position and back. On the other side, the lengthened axle of the roller on the outlet side is at the same time the pivot axis of the module for pivoting the front part, in the conveying direction, of the conveyor module during the closing movement of the preceding module following the expulsion, in order to ensure trouble-free transfer of the materials to be conveyed from the respectively preceding conveyor module even before the horizontal end position of said conveyor module.

In the conveying direction, the front part of the conveyor module 1, like the rear part, is located in the upper end position which, during one transport cycle for material to be conveyed on the conveyor module 1, is assumed for the greatest time interval. In order that this pivoting movement can be executed in the most energy-saving manner, this upper end position is maintained by means of an energy store in the form of a compression spring 13. If the module part on the inlet side is to be pivoted downward, a lifting element 12 (a lifting magnet in this case) is activated, which acts on the front conveyor module part, in the conveying direction, on the lengthened axle of the deflection roller. Following deactivation of the lifting element 12, this conveyor module part is urged back into its upper end position again by the compression spring 13. On the conveyor belt 2 there is precisely one item of material 3 to be conveyed. In order to execute the pivoting movement for expulsion, the roller on the outlet side is mounted on a push rod 7 of a crank drive. A crank drive has been selected in order that the movement proceeds sinusoidally and therefore no impermissibly high accelerations occur, which would entail the material to be conveyed jumping on the conveyor belt 2. According to FIG. 1, the conveyor belt 2 is in the horizontal conveying position from module to module, and the crank drive is likewise located just at top dead center. The arrow indicates the half-rotation of the crank to bottom dead center to be executed for the expulsion position of FIG. 2, that is to say the crank diameter corresponds to the expulsion stroke of the conveyor module. The arrow in FIG. 2 indicates that, for the purpose of pivoting upward, the crank 6 executes half a revolution upward in the opposite direction of rotation.

Since this drive is also intended to use as little energy as possible, but movement times are to be as short as possible, an energy store in the form of a tension spring 4 is employed, which is connected to the crank 6 at the connecting point to the push rod 7. During the downward expulsion of material 3 to be conveyed located on the conveyor module 1, as a result of a downward half-revolution of the crank 6, the tension spring 4 is tensioned by the drive and the mass of the conveyor module 1 and of the material 3 to be conveyed. Once the material 3 to be conveyed has been expelled, the conveyor module 1 must then pivot upward as quickly as possible in order to avoid the following material 3 to be conveyed being clamped in when there are short gaps between the materials 3 to be conveyed. The tensioned spring makes it possible to carry out this procedure quickly with relatively little energy.

In order to limit the crank movement, an upper stop 9 and a lower stop 10 are provided, the upper stop 9 being located slightly behind top dead center and the lower stop 10 being located at bottom dead center or shortly before the latter. The drive can be implemented, for example, by means of a stepping motor or by means of a DC geared motor. The opposite mounting of the tension spring 4 is fixed to a spring suspension 5 and is located above the upper stop 9. As a result, the crank 6 is pulled against the upper stop 9 by the tension spring 4 into a slightly bent position and also against the lower stop 10 when it is moved beyond the imaginary snap-over line 11, which runs in a straight line through the opposing mounting and the axis of rotation 8 of the crank. In this way, it is ensured that the crank 6 remains in a defined way in the end positions without special locking means or drives with energy-consuming retaining functions being necessary.

Because of the high dynamics of the rotational movement at a rotational speed of Vmax=3 revolutions per second, stopping which ends quickly (<50 ms) and exactly at the stops 9, 10 is not possible without angle registration and control, since the stopping point is influenced, for example, by

- loading of the conveyor module by the material to be conveyed (weight variance)
- winding temperature of the motor
- bearing friction
- production tolerances of all types (conveyor module weight, motor tolerances)
- operating voltage of the DC motor.

The factors also influence the pivoting times of the conveyor module 1.

In order to ensure the most equal pivoting times possible and defined stopping points, a DC motor is operated with a voltage slightly higher than the rated voltage (about 10–20% more), which would lead to an excessively fast changeover time in the event of a conveyor module being loaded only lightly.

From the movement of the motor, registered via two devices for registering angles, implemented as Hall sensors, a device for registering current and a thickness, height and length sensor possibly located before a sorting section, a motor control system obtains all the information required in order to influence the motor, by means of pulse width modulation, in such a way that the movement does not fall below a predefined minimum time, even with a conveyor module loaded lightly, and the dynamics also approximate a reference curve. The device for registering current permits reliable determination of the load torque since, in the DC motor, I=f(M).

The thickness, height and length sensor and its measured information replaces complicated weighing, if there is an assumed proportionality between volume and weight.

In order to detect the direction of rotation/rotational speed of the motor, two Hall sensors are arranged in an offset manner on the motor shaft.

The reserves of power not used in the case of a very light item of mail are then available to compensate for the loading factors and interfering variables listed further above, by which means a constant changeover time is achieved. Also derived from the sensor information by the motor control system are the turn-on time of the braking and its duration, in order to permit the stops 9, 10 to be approached accurately. By this means, resilient stops, unnecessary wear, noise, etc. are avoided. The turn-on time of the braking and its duration is determined dynamically on the basis of the load torque and the angular speed/angular position of the crank drive. The motor control system can drive the motor in such a way that the crank no longer has any movement energy at the stops.

For particularly gentle and jolt-free pivoting of the conveyor module 1, the angular speed of the drive motor has a sinusoidal curve, so that the pivoting operation of the conveyor module 1 has an adjustable course.

In a further simple drive design with angle position sensors and control of the motor, which can be applied if, for example, no high requirements are placed on maintaining specific pivoting times of the conveyor modules 1, or the influences of the interfering variables are low (e.g. low weight variance), the time-controlled drive is designed in such a way that the resilient stops absorb part of the movement energy of the crank drive even under different operating conditions (high operating voltage, low bearing friction, minimally loaded conveyor module).

Since the front part, in the conveying direction, of the conveyor module 1 is merely pivoted downward unloaded and is pivoted upward only with the front part of an item of material, the requirements placed on this drive are not so high, so that here an appropriately dimensioned lifting element 12 with a spring element 13 is sufficient.

The sequence of the pivoting movements of the front part, in the conveying direction, of the conveyor module 1, together with the circulating conveyor belt 2, is illustrated in FIGS. 3*a–c*, for clarity, only the drive of the front part, in the conveying direction, of the conveyor module 1 carrying out the opposite pivoting movement being illustrated. The material 3 conveyed is flat items of mail. According to FIG. 3*a*, the material 1 to be conveyed is just leaving the conveyor module 1 pivoted downward. The following material 3 to be conveyed is already located partly on the downwardly pivoted conveyor module 1, but is to be transported onward. Immediately after the material 3 to be conveyed and expelled has left the conveyor module 1, the latter is pivoted upward again. At the same time, the front part, in the conveying direction, of the following conveyor module 1 is pivoted downward by means of the lifting element 12 and a compression spring 13 at least until its conveying level has reached the conveying level of the conveyor module 1 which is pivoting upward and has just expelled the preceding material 3 to be conveyed (FIG. 3*b*). Then, this front part, in the conveying direction, of the following conveyor module 1 is pivoted upward again, so that at the end of this movement cycle, both conveyor modules 1 are located in the horizontal end position (FIG. 3*c*). Because of this opposite pivoting movement, the distance between the materials to be conveyed can be shortened in such a way that a transfer to the respectively following conveyor module 1 can take place as soon as both conveyor modules 1 at the transfer point are at one height and not just when the horizontal end positions have been reached.

What is claimed is:

1. A conveyor for transporting flat items, comprising:

a series of conveyor modules which are arranged one behind another for transporting flat items in a conveying direction;

a first pivot mechanism supporting a front end of each conveyor module;

a second pivot mechanism supporting a rear end of each conveyor module;

means for vertically displacing the front end of each conveyor module by pivoting it about the first pivot mechanism, including a first drive element for moving the conveyor module between a horizontal transport position and a pivoted recovery position;

means for vertically displacing the rear end of each conveyor module by pivoting it about the second pivot mechanism, including a second drive element for moving the conveyor module between a horizontal transport position and a pivoted expulsion position; and a controller actuating the means for vertically displacing the front and rear ends of each conveyor module, whereby during a closing movement of a rear end of an expelling conveyor module wherein the expelling conveyor module is returning from the expulsion position to the horizontal transport position, the controller causes the front end of the conveyor module adjacent and downstream from the expelling conveyor module to pivot down from its horizontal transport position to the pivoted recovery position, and then return to its horizontal transport position while maintaining a position wherein its front end is below or the same height as the rear end of the expelling module, such that a flat item following the flat item just expelled is supported by both the rear end of the expelling conveyor module and the front end of the adjacent downstream conveyer module as both modules return to respective horizontal transport positions.

2. The conveyor as claimed in claim 1, characterized in that the front end of the conveyor module adjacent and downstream from the expelling conveyor module is pivoted downward only until the front end of the conveyor module adjacent and downstream from the expelling conveyor module is at the same height as the rear end of the expelling module and is then immediately pivoted upward again.

3. The conveyor as claimed in claim 1, characterized in that the front end of each conveyor module is guided in a substantially vertical direction by the first vertical displacement means and the rear end is guided in both a vertical and horizontal direction by the second vertical displacement means.

4. The conveyor as claimed in claim 3, further comprising a controllable lifting element connected to the front end of the conveyor module for moving the front end of the conveyor module in a substantially vertical direction.

5. The conveyor as claimed in claim 3, further comprising a spring element connected to the front end of the conveyor module for moving the front end of the conveyor module in a substantially vertical direction.

6. The conveyor as claimed in claim 1 further comprising a crank drive including a push rod wherein the rear end of the module is connected to the push rod for movement in a vertical and horizontal direction.

7. A conveyor system for conveying and expelling flat items, the system including a plurality of adjacent modules comprising:

means for lowering the rear end of a first module from a horizontal transport position to an expelling position to expel a first flat article;

means for lowering the front end of an second adjacent downstream module from a horizontal transport position to a recovery position, wherein the front end of the second module is at the same height or lower than the rear end of the first module;

means for simultaneously raising the rear end of the first module and the front end of the second module such that a second flat article following the first flat article is supported by the rear end of the first module and the front end of the second module as the rear end of the first module and the front end of the second module return to the respective horizontal transport positions.

8. A conveyor for transporting flat items, comprising:

a series of conveyor modules which are arranged one behind another for transporting flat items in a conveying direction;

a first pivot mechanism supporting a front end of each conveyor module;

a second pivot mechanism supporting a rear end of each conveyor module;

a drive element for vertically displacing the front end of each conveyor module by pivoting the front end about the first pivot mechanism between a horizontal transport position and a pivoted recovery position and a spring for upwardly biasing the front end to a horizontal transport position;

a crank drive for vertically displacing the rear end of each conveyor module by pivoting the rear end about the second pivot mechanism between a horizontal transport position and a pivoted expulsion position; and a controller actuating the drive element and crank drive for vertically displacing the front and rear ends of each conveyor module, whereby the front end of the conveyor module adjacent and downstream from a conveyor module with a rear end in the expulsion position is pivoted down from its horizontal transport position to the pivoted recovery position, and returned to its horizontal transport position while maintaining a position wherein the front end is below or the same height as the rear end of the expelling module, such that a flat item following the expelled item on the conveyor is supported by both the rear end of the expelling conveyor module and the front end of the adjacent downstream conveyer module as both modules return to respective horizontal transport positions.

* * * * *